US005971243A

United States Patent [19]

Peterson

[11] Patent Number: 5,971,243

[45] Date of Patent: Oct. 26, 1999

[54] STORAGE POCKET FOR INFLATABLE TOWABLE VEHICLE

[75] Inventor: Leroy L. Peterson, Omaha, Nebr.

[73] Assignee: Sportsstuff, Inc., Omaha, Nebr.

[21] Appl. No.: 09/141,036

[22] Filed: Aug. 27, 1998

[51] Int. Cl.[6] ..... B60R 9/00

[52] U.S. Cl. ..... 224/572; 114/254; 224/406; 441/66

[58] Field of Search ..... 244/572, 603, 244/920, 929, 934; 441/40, 42, 66, 130, 131; 150/154, 166; 220/594.24; 114/345, 347, 253, 254

[56] References Cited

U.S. PATENT DOCUMENTS

| | | | |
|---|---|---|---|
| 3,095,568 | 6/1963 | Aine et al. | 343/709 |
| 3,653,084 | 4/1972 | Hartman | 441/40 |
| 4,083,070 | 4/1978 | Martin | 441/40 |
| 5,122,086 | 6/1992 | Remy | 441/66 |
| 5,503,099 | 4/1996 | Peterson | 114/253 |
| 5,713,773 | 2/1998 | Churchill | 441/66 |

*Primary Examiner*—Stephen P. Garbe
*Assistant Examiner*—Maerena W. Brevard
*Attorney, Agent, or Firm*—Henderson & Sturm

[57] ABSTRACT

A storage pocket for an inflatable towable vehicle that includes an inflatable member and a protective outer shell. The storage pocket includes a flexible panel attached to the outer shell by sewing or other suitable methods. The flexible panel comprises a continuous solid lower portion and an open weave net upper portion that allows ventilation of the storage compartment to prevent mildew of items stored. Indicia on the lower portion may include warnings and water safety information. Attachment of the storage pocket to the outer shell conserves valuable interior space in the towable vehicle and does not interfere with passenger comfort.

11 Claims, 1 Drawing Sheet

STORAGE POCKET FOR INFLATABLE TOWABLE VEHICLE

BACKGROUND OF THE INVENTION

1. Field of the Invention

The present invention relates to the field of storage devices, and more particularly to a storage pocket for an inflatable towable vehicle.

2. Description of the Related Art

Storage compartments for use with towable water vehicles are typically separate units that may be lost if the towable vehicle capsizes. Also, storage compartments used in an aquatic environment are subject to problems with mold or mildew. In addition, storage compartments generally occupy valuable interior passenger space and interfere with the comfort of the passengers.

Those concerned with these and other problems recognize the need for an improved storage pocket for an inflatable towable vehicle.

BRIEF SUMMARY OF THE INVENTION

The present invention provides a storage pocket for an inflatable towable vehicle that normally includes an inflatable member and a protective outer shell. The storage pocket includes a flexible panel attached to the outer shell by sewing or other suitable methods. The flexible panel comprises a continuous solid lower portion and an open weave net upper portion that allows ventilation of the storage compartment to prevent mildew of items stored. Indicia on the lower portion may include warnings and water safety information. Attachment of the storage pocket to the outer shell conserves valuable interior space in the towable vehicle and does not interfere with passenger comfort.

Therefore, an object of the present invention is the provision of an improved storage pocket for an inflatable towable vehicle.

BRIEF DESCRIPTION OF THE SEVERAL VIEWS OF THE DRAWINGS

Other objects, advantages, and novel features of the present invention will become apparent from the following detailed description of the invention when considered in conjunction with the accompanying drawings, wherein.

DETAILED DESCRIPTION OF THE INVENTION

Figure 1:
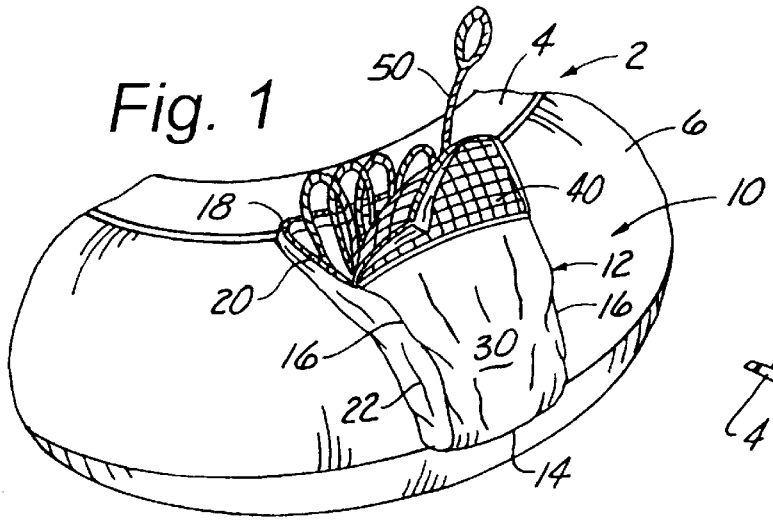
FIG. 1 is a partial perspective view of the storage pocket of the present invention attached to the outer surface of an inflatable towable vehicle.
Figure 2:
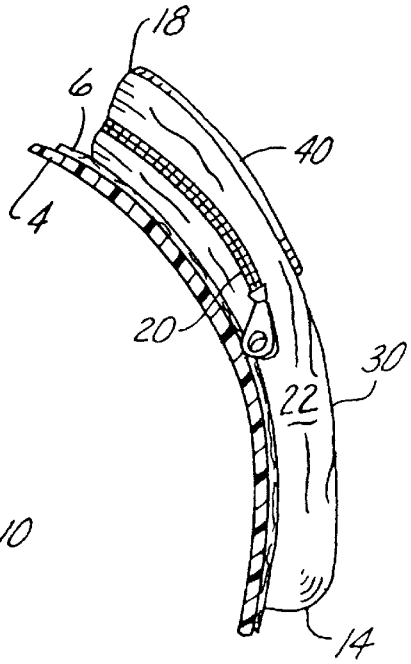
FIG. 2 is a side elevation sectional view of the storage pocket.

Referring now to the drawings, wherein like reference numerals designate identical or corresponding parts throughout the several views, FIGS. 1–4 show the storage pocket 10 of the present invention attached to the forward or leading edge section of an inflatable towable vehicle 2 as it is towed on the surface of the water. The inflatable towable vehicle 2 includes an inflatable member 4 constructed of a plastic material such as polyvinylchloride (PVC), and a protective outer shell 6 constructed of a durable fabric such as nylon, polyester or Dacron.

The storage pocket 10 includes a flexible panel 12 with its bottom 14 and lateral sides 16 attached to the outer shell 6 by sewing or other suitable means. The top 18 of the panel 12 defines an opening to the storage compartment, and a zipper closure 20 is used to selectively allow or prevent access to the compartment. An expandable web section 22 interconnects the flexible panel 12 and the protective outer shell 6 of the towable vehicle 2.

Figure 4:
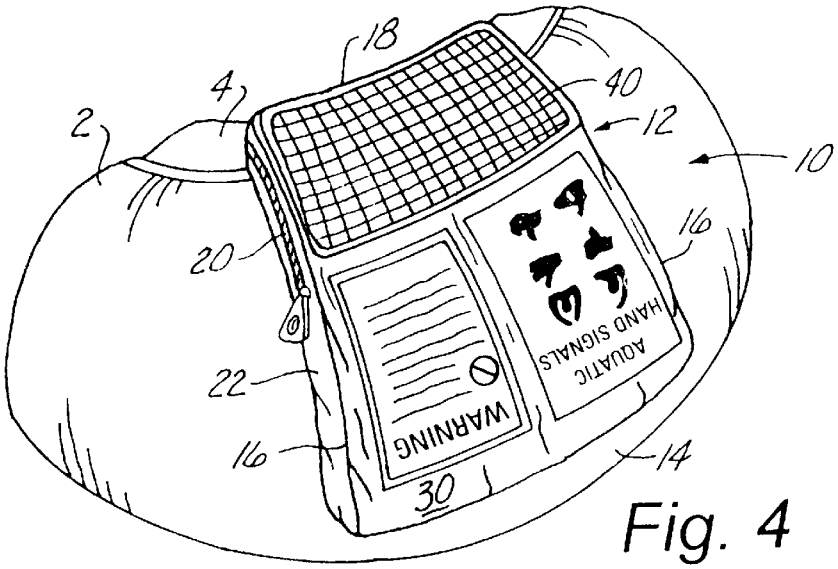
FIG. 4 is a partial perspective view of another alternate embodiment of the storage pocket also being of a different shape and size, and further having indicia on the solid lower portion relating to vehicle use warnings and aquatic safety.

The continuous lower portion 30 of the flexible panel 12 may carry indicia such as warnings and safety information as illustrated in FIG. 4. The upper portion 40 of the flexible panel 12 is formed of an open-weave net that allows moisture to escape from the storage compartment. This is particularly suited to storage of a wet tow rope 50 used to tow the vehicle 2.

Figure 3:
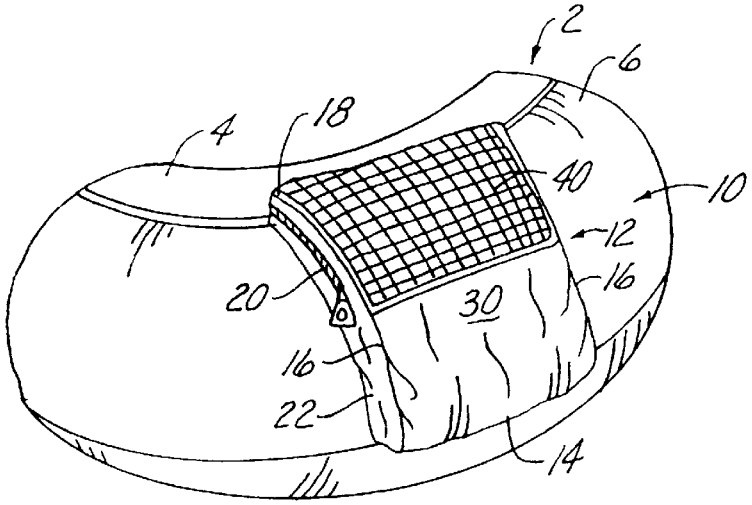
FIG. 3 is a partial perspective view of an alternate embodiment of the storage pocket being of a different shape and size.

As illustrated by comparison of FIGS. 1, 3 and 4, the shape and size of the storage pocket may vary and be adapted to a particular towable vehicle. Also, the proportions of the solid lower portion 30 and open-weave net upper portion 40 may vary to accommodate aesthetic or cost considerations.

In use items may be stored in the storage pocket 10 while the towable vehicle 2 is in use. The storage pocket 10 is particularly useful for storage of wet items such as a tow rope 50 since the open-weave net upper portion 40 provides ventilation and prevents mildew. Being located on the forward section of the protective shell 6 adjacent the normal point of attachment of a tow rope 50 on the outer wall of the vehicle 2, the storage pocket 10 does not use valuable interior space or interfere with the comfort of the vehicle passengers.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A storage pocket in combination with an inflatable towable vehicle including an inflatable member and a protective outer shell disposed to receive the inflatable member and having a forward section, the storage pocket comprising:

a flexible panel having a bottom, lateral sides, and a top; the panel being attached at the bottom and lateral sides to the outer shell to form a compartment having an opening in the top of the panel and including a continuous lower portion and an open-weave net upper portion; and a closure member provided in said opening in the top of the panel wherein the closure member is operable to selectively allow or prevent access to the compartment.

2. The storage pocket of claim 1, wherein the closure member includes a zipper.

3. The storage pocket of claim 1, further including an expandable web section formed integrally with the lateral sides of the flexible panel.

4. The storage pocket of claim 1, wherein the solid lower portion carries indicia.

5. The storage pocket of claim 4, wherein the indicia include warnings concerning the operation of the towable vehicle.

6. The storage pocket of claim 1, wherein the flexible panel is disposed on a forward section of the outer shell adjacent to the normal point of attachment of a vehicle tow rope.

7. The storage pocket of claim 6, wherein the compartment is disposed to selectively receive and store the vehicle tow rope when it is not in use, wherein moisture from the tow rope escapes through the open-weave net upper portion of the flexible panel even when access to the compartment is prevented by the closure member.

8. The storage pocket of claim 7, wherein the closure member includes a zipper.

9. The storage pocket of claim 8, further including an expandable web section formed integrally with the lateral sides of the flexible panel.

10. The storage pocket of claim 9, wherein the solid lower portion carries indicia.

11. The storage pocket of claim 10, wherein the indicia include warnings concerning the operations of the towable vehicle.

* * * * *